United States Patent [19]

Trainor

[11] 4,184,564

[45] Jan. 22, 1980

[54] COMBINATION MUFFLER AND AIR FILTER

[76] Inventor: John B. Trainor, 2375 S. Commerce, Walled Lake, Mich. 48088

[21] Appl. No.: 3,591

[22] Filed: Jan. 15, 1979

Related U.S. Application Data

[62] Division of Ser. No. 828,744, Aug. 29, 1977, Pat. No. 4,134,472.

[51] Int. Cl.[2] ..... F01N 1/24; F01N 7/18

[52] U.S. Cl. ..... 181/230; 181/243; 181/258; 181/267; 181/269

[58] Field of Search ..... 181/230, 243, 258, 267, 181/256, 269; 173/DIG. 2; 55/DIG. 21, DIG. 30, 276

[56] References Cited

U.S. PATENT DOCUMENTS

| | | | |
|---|---|---|---|
| 3,380,553 | 4/1968 | Gibel | 181/230 |
| 3,563,338 | 2/1971 | Radar | 181/243 |
| 3,688,870 | 9/1972 | Gibel | 181/267 |
| 3,719,251 | 3/1973 | Hedrick | 181/230 |
| 4,134,472 | 1/1979 | Trainor | 181/258 |

*Primary Examiner*—L. T. Hix
*Assistant Examiner*—Benjamin R. Fuller
*Attorney, Agent, or Firm*—Gifford, Chandler, VanOphem, Sheridan, & Sprinkle

[57] ABSTRACT

A combination muffler and air filter is provided having a central tubular member with spaced longitudinally disposed elongated slots. A disposable canister on the central tubular member is removably held in position by retainer caps engaged on the ends of the central tubular member. One of the retainer caps is adapted for connection to the exhaust conductor from a pneumatically operated device. The disposable canister has a perforated cylinder encasing a series of stacked annular members having both muffling and filtering properties. A perforated sleeve in the disposable canister supportively engages the inner periphery of the stacked annular members. A closure disc, fixed on each end of the perforated cylinder, holds the stacked annular members in a compact and compressed condition.

2 Claims, 4 Drawing Figures

FIG-1
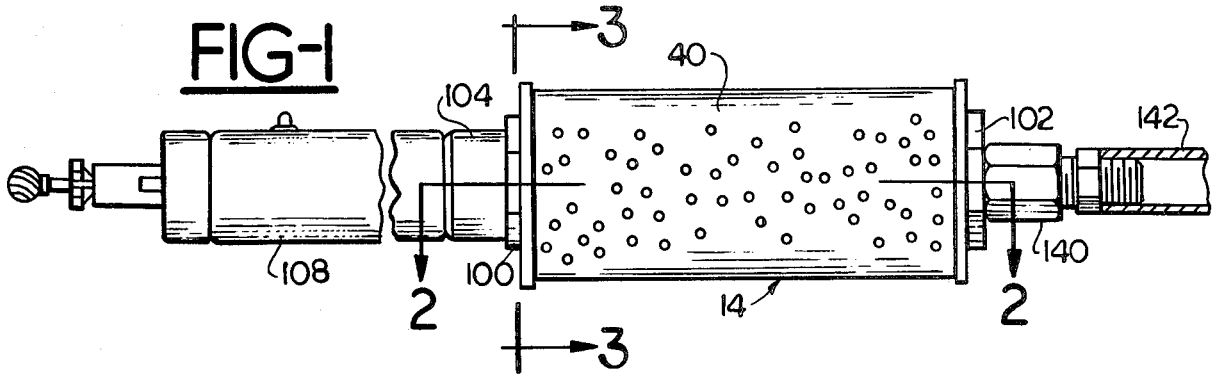
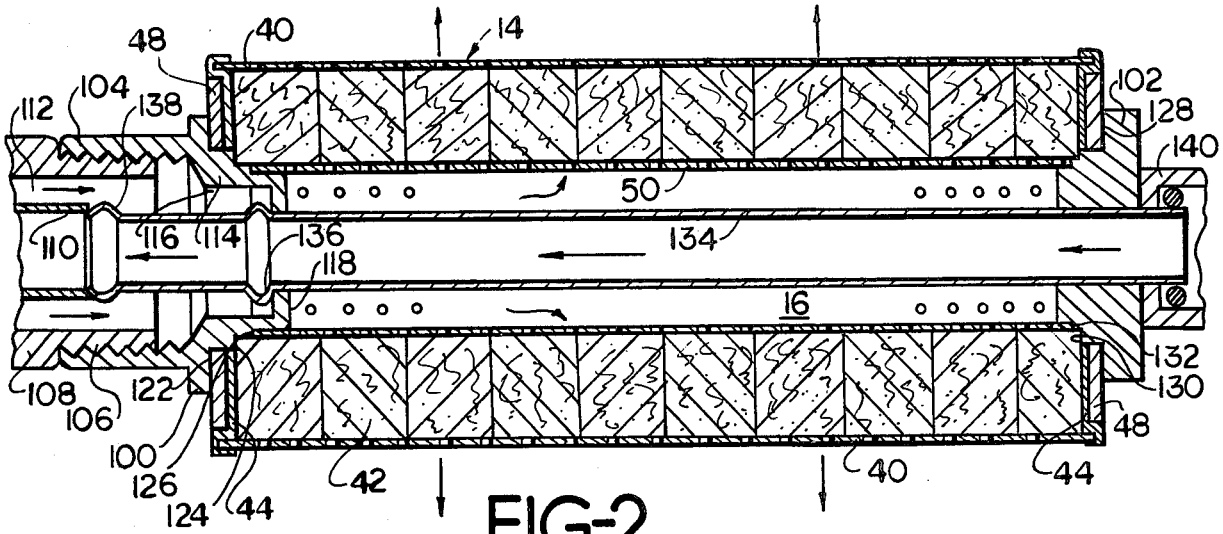
FIG-2
FIG-3
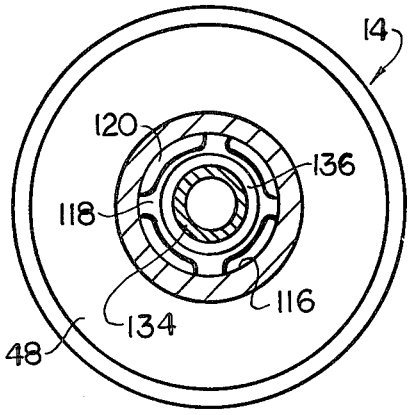
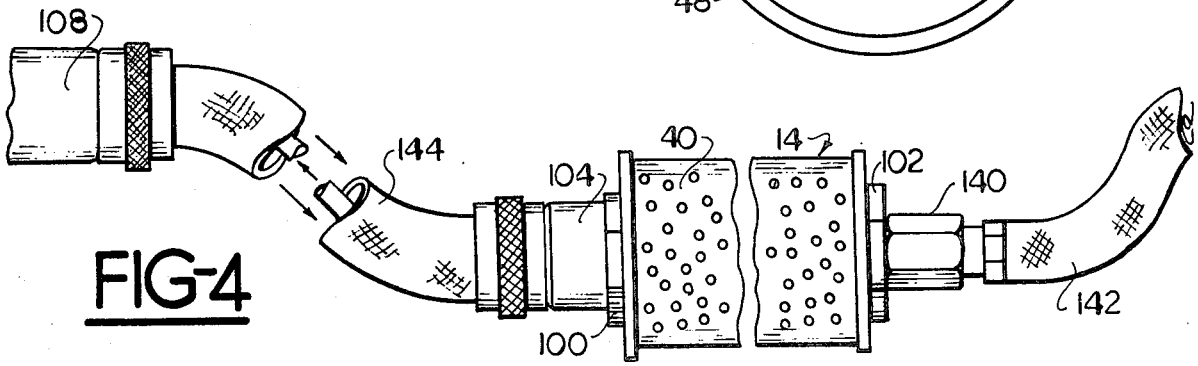
FIG-4

COMBINATION MUFFLER AND AIR FILTERCROSS-REFERENCE TO RELATED APPLICATION

This application is a divisional application of my U.S. Pat. application Ser. No. 828,744, filed Aug. 29, 1977 now U.S. Pat. No. 4,134,472 Combination Muffler and Air Filter.

BACKGROUND OF THE INVENTION

I. Field of the Invention

This invention relates generally to devices for muffling and filtering air exhausted from pneumatically operated tools, equipment, and machines, such as hoists and presses.

II. Description of the Prior Art

Many of the difficulties and malfunctions encountered in the operation of such compressed air operated devices are caused by excessive back or surge pressures relating from faulty design or defects in the muffling and filtering units. Excessive pressures can cause explosions or recycling thereby damaging equipment and producing hazards to the safety of operating and maintenance personnel.

SUMMARY OF THE INVENTION

The present invention provides a combination muffler and air filter which effectively prevents the occurrence of excessive discharge pressures in pneumatically operated devices, machines, and compressed air systems generally. THe combination muffler and air filter of the present invention, also provides an effective means for removing entrained solid and liquid contaminates from the exhausted air before it is discharged to the atmosphere.

The invention consists of a central tubular member having a series of spaced longlid longitudinally disposed elongated slots. A disposable canister, on the central tubular member, is removably held in position by top and bottom retainer caps mounted on the ends of the central tubular member.

The top retainer cap has an intake port communicating with the central tubular member.

The bottom retainer cap has therein an annular sump connected by lateral ducts with a central drain opening.

The disposable canister has a perforated cylinder encasing a series of stacked annular members, of felt or other suitable filtering materials. A perforated sleeve in the disposable canister supportively engages the inner periphery of the stacked annular members. A closure disc, fixed on each end of the perforated cylinder, holds the stacked annular members in a compact and compressed condition.

BRIEF DESCRIPTION OF THE DRAWINGS

FIG. 1 is a side elevation view, showing the present invention for use with conventional pneumatic hand tools.

FIG. 2 is a section view, taken substantially on line 2—2 in FIG. 1, showing structural details of the various components.

FIG. 3 is a section view, taken substantially on line 3—3 in FIG. 1, showing internal construction of a front retainer cap.

FIG. 4 is a side elevation view, with a portion of a two-way flexible tubing cut away, showing the combination muffler and air filter of FIG. 1 connected to provide a remote exhaust for a pneumatic hand tool.

DESCRIPTION OF THE PREFERRED EMBODIMENT

For the detailed description of the preferred embodiment of the present invention, reference is made to FIGS. 1 through 4 of the drawings, in which the numeral 134 designates a central tubular member. The central tubular member 134 extens through a disposable canister 14 having a perforated cylinder 40 and containing stacked annular members 42, of felt or other suitable material, having satisfactory muffling and filtering properties.

A closure disc 44 on each end of the perforated cylinder 40 is permanently attached thereto, by crimping or other satisfactory means, and holds the stacked annular members 42 in a compact and compressed condition. A perforated sleeve 50 the disposable canister 14 supportively engages the inner periphery of the stacked annular members 42.

FIGS. 1 through 4 illustrate the present invention for use with conventional pneumatic hand tools such as drills and grinders.

In this preferred embodiment, the disposable canister 14 is provided with a front and a rear retainer cap 100 and 102 respectively, seated on flat washers 48 bearing directly on closure discs 44 of the perforated cylinder 40. A tubular extension 104 on the front retainer cap 100 has an internally threaded section 106 for detachably engaging the connector to a conventional pneumatic tool 108 as shown in FIGS. 1 and 2. An intake tube 110 in the tool 108, for receiving compressed air with which to operate the unit, includes an annular exhaust chamber 112 encompassing the tube 110.

A rearwardly disposed projection 114 on the front retainer cap 100 forms a cylindrical chamber 116 with a back wall 118 having therein four spaced discharge ports 120 providing communication between the annular exhaust chamber 112 in the pneumatic tool 108 and the axial opening 16 through the canister 14. A series of three longitudinally spaced shoulders 122, 124 and 126, on the periphery of the rearwardly disposed projection 114, provide annular seats for the flat washer 48 and the stacked annular members 42 and perforated sleeve 50 respectively in the disposed canister 14.

Three longitudinally spaced annular shoulders 128, 130 and 132, on the rear retainer cap 102, provide seats for the flat washer 48, the stacked annular members 42 and perforated sleeve 50 respectively at the other end of the disposable canister 14. The sleeve 50 extends slidably through both the front and rear retainer caps 100 and 102 respectively. An annular shoulder 136, on the forward portion of the central tubular member 134, is seated on the back wall 118 of the cylindrical chamber 116.

A terminal enlargement 138, on the forward end of the central tubular member 134, sealably engages the end of the intake tube 110 in the pneumatical tool 108 as shown in FIG. 2. A connector 140 on a flexible hose 142 detachably engages the other end of the central tubular member 134. In the event it is desired to provide a remote discharge for the pneumatic tool 108, a two-way flexible hose 144 is inserted between the combination muffler and filter of the present invention and the pneumatic tool 108, as shown in FIG. 4.

This completes a description of the structure comprising and characterizing this embodiment of the present invention. However, to facilitate a more thorough and comprehensive understanding of the subject matter, a discussion of the manner in which the device is used and operates to fulfill its intended function follows.

Intake air enters the central tubular member 134 through the connector 140 and passes to the pneumatic tool 108 as shown by the directional arrows (FIG. 2) in tubular member 134. Exhaust air returns from the tool 108 through the exhaust chamber 112, cylindrical chamber 116, and the discharge ports 120. The exhaust air then passes into the axial opening 16 where it is forced through the perforated sleeve 50 and the annular members 42, thereby muffling and filtering the exhaust air before it passes through the perforations in the cylinder 40. The canister 14 can be replaced periodically with a fresh unit.

Based upon the foregoing discussion, it is apparent that the present invention has fulfilled a long-felt need in the field of mufflers and air filters, and that the invention constitutes a valuable contribution to the related art. The invention, however, was described with reference to the structural details relating to a single embodiment, but it will be appreciated by those familiar with the art that the principles involved are susceptible of numerous other practical adaptations.

I claim:

1. A combination muffler and air filter for use in combination with a pneumatic tool, said tool having an air intake tube and an exhaust chamber, said combination muffler and air filter comprising:

a canister having an axial opening extending therethrough, said canister comprising:

a perforated cylinder, annular members with muffling and filtering properties stacked in said perforated cylinder, and a closure disc on each end of said perforated cylinder;

a rear retainer cap on one end of said canister;

a front retainer cap on the other end of said canister, said front cap having a rearwardly disposed projection containing a housing having a chamber, said housing having a back wall with spaced discharge ports communicating said exhaust chamber in said pneumatic tool with said axial opening through said canister, said front cap also having means thereon for detachably connecting said muffler and filter to said pneumatic tool; and a central tubular member slidably extending through said front and rear retainer caps and said rearwardly disposed projection, said member having means on the forward end thereof for sealably engaging said intake tube of said pneumatic tool, whereby air exhausted from said pneumatic tool is filtered and muffled before being releasesd to the atmosphere.

2. A combination muffler and air filter as defined in claim 1 further comprising a perforated sleeve supportively engaging the inner periphery of said annular members stacked in said perforated cylinder of said canister.

* * * * *

UNITED STATES PATENT AND TRADEMARK OFFICE

CERTIFICATE OF CORRECTION

PATENT NO. : 4,184,564

DATED : January 22, 1980

INVENTOR(S) : John B. Trainor

It is certified that error appears in the above-identified patent and that said Letters Patent are hereby corrected as shown below:

Column 1, line 33, delete "THe" and insert --The--therefor;
Column 1, line 39, after "spaced" delete "longlid";
Column 2, line 19, after "50" insert --in--.

Signed and Sealed this

*Sixth* Day of *May 1980*

[SEAL]

*Attest:*

SIDNEY A. DIAMOND

*Attesting Officer*

*Commissioner of Patents and Trademarks*